US007352979B2

(12) United States Patent
Funabiki et al.

(10) Patent No.: US 7,352,979 B2
(45) Date of Patent: Apr. 1, 2008

(54) IMAGE FORMING APPARATUS HAVING A COOLING SECTION IN A FIXING APPARATUS

(75) Inventors: Hiroshi Funabiki, Uenohara (JP); Masami Maruko, Hachioji (JP); Mikihiko Takada, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/339,507

(22) Filed: Jan. 26, 2006

(65) Prior Publication Data

US 2006/0269307 A1 Nov. 30, 2006

(30) Foreign Application Priority Data

May 27, 2005 (JP) ..... 2005-155125

(51) Int. Cl.
*G03G 15/20* (2006.01)

(52) U.S. Cl. ..... 399/68; 399/45

(58) Field of Classification Search ..... 399/45, 399/67, 68

See application file for complete search history.

(56) References Cited

U.S. PATENT DOCUMENTS 5,325,164 A * 6/1994 Tai et al. ..... 399/322
5,960,242 A * 9/1999 Greive ..... 399/302
6,580,884 B2 * 6/2003 Kuwabara ..... 399/92
6,987,936 B2 * 1/2006 Satoh et al. ..... 399/88

FOREIGN PATENT DOCUMENTS

| | | |
|---|---|---|
| JP | 6-242701 | 9/1994 |
| JP | 10-020707 | 1/1998 |
| JP | 11-194647 | 7/1999 |

OTHER PUBLICATIONS

English Abstract of JP 05-119669.*

* cited by examiner

*Primary Examiner*—David M. Gray
*Assistant Examiner*—Ruth N LaBombard
(74) *Attorney, Agent, or Firm*—Finnegan, Henderson, Farabow, Garrett and Dunner, L.L.P.

(57) ABSTRACT

An image forming apparatus including: an image bearing body; an image forming section to form a toner image on the image bearing body; a transfer section to transfer the toner image on a recording material; and a fixing apparatus having a pressure member and a heating member, which fixes the toner image on the recording material transported their between, wherein the fixing apparatus comprises a cooling section to cool the pressure member, and a controlling section to control the cooling section according to an interval between recording materials.

9 Claims, 5 Drawing Sheets

IMAGE FORMING APPARATUS HAVING A COOLING SECTION IN A FIXING APPARATUS

This application is based on Japanese Patent Application No. 2005-155125 filed with Japan Patent Office on May 27, 2005, the entire content of which is hereby incorporated by reference.

BACKGROUND OF THE INVENTION

1. Field of the Invention

The present invention relates to image forming apparatuses such as copying apparatuses, printers, etc., that carry out image forming using the electrophotographic method, and in particular, to image forming apparatuses that carry out fixing of unfixed toner images using a fixing unit by applying heat and pressure.

2. Description of Related Art

In an image forming apparatus, the toner images formed on an image bearing body (photoreceptor) or on an intermediate transfer body are transferred by an image transfer section on to a recording material (also called a transfer material), and the recording material carrying the toner image is subjected to heat and pressure when it passes through the fixing nip section formed by a heat fixing member and a pressure member of the fixing unit that are in a pressure contact state, and the toner gets fixed on to the recording material due to adhesion.

During such fixing, there is a phenomenon called blistering that is not desirable for image formation. Blistering is a phenomenon that occurs mainly when coated paper with a low basis weight is used as the recording sheet, and is a phenomenon in which image blemishes appear with the surface of the toner layer becoming textured because, while the coated paper passes through the nip section of the fixing unit, the air or moisture in the toner layer cannot escape to the outside but become bubbles within the toner image, and also because the moisture in the coated paper passes through the coating layer and evaporates.

While the coated paper is passing through the nip section comprising a heat fixing member which is, for example, a fixing belt, and a pressure member which is, for example, an external pressure roller, the toner image is fixed by melting on top of the recording material, and while it is necessary to take the toner layer to a sufficiently high temperature in order to obtain the necessary glossiness, because of this heating, the recording material and the layer below the toner image that does not contribute to the glossiness are also heated more than is necessary, thereby causing the blistering phenomenon. It has been known that the temperature of the pressure member has a large influence on the temperature of the recording material and of the layer below the toner image, and the generation of blisters is reduced by maintaining the temperature of the pressure member at a low value.

However, since the external pressure roller is in pressure contact with the fixing belt during image formation, the temperature of the external pressure roller exceeds the permissible temperature due to the heat received by it from the fixing belt through the paper interval or outside the sheet passing region even though it is not heated intentionally, thereby resulting in an environment of generating blisters.

In Patent Document 1, as a means for preventing the generation of blisters, a configuration has been disclosed in which the set temperatures of the heat fixing roller which is a heat fixing member and of the endless belt shaped pressure member are set at different values, and, based on the respective detected temperature conditions that have been detected using sensors, the heat fixing roller and the pressure member are rotated respectively in a state in which they are separated from each other.

In the disclosure made in Patent Document 2, in order to prevent wrinkling of the transfer material or disturbances in the fixed image, it has been disclosed to arrange four cooling fans in the axial direction of the pressure roller, these fans are driven according to the size of the sheet, thereby lowering the temperature of the high temperature parts of the pressure roller.

In the disclosure made in Patent Document 3, as a method of shifting the optimum amount of heating of the fixing roller from the high heating amount to low heating amount, a cooling fan that cools the periphery of the fixing roller, and when the temperature of the fixing roller becomes higher than the set fixing temperature range, based on the temperature detection signal from the temperature detecting means, the control means drives the cooling fan thereby lowering the temperature of the entire fixing roller uniformly.

Patent Document 1: Unexamined Japanese Patent Application Publication No. Hei 11-194647

Patent Document 2: Unexamined Japanese Patent Application Publication No. Hei 6-242701

Patent Document 3: Unexamined Japanese Patent Application Publication No. Hei 10-20707

In order to prevent the generation of blisters, the method in Patent Document 1 of separating the heat fixing member and pressure member is not desirable because during continuous printing, the problem that the printing has to be interrupted in order to separating these two members, etc.

Further, in order to cool the external pressure roller, the method of cooling by applying an air blow from outside the roller using a cooling fan as disclosed in Patent Documents 2 or 3 causes heat pollution because the hot air gets dispersed within the equipment after cooling.

Apart from using a cooling fan, although there is the method of cooling the surface of the roller by making a heat pipe come into contact with the external pressure roller, it is difficult to obtain sufficient cooling effect because a temperature difference is necessary between the surface of the roller and the heat pipe in order to carry out cooling.

In order to cool the external pressure roller, when detecting the temperature of the external pressure roller and then starting the cooling using these cooling means, there will be a delay before the cooling effect appears due to the thermal capacity of the roller itself and the cooling may not be done in time.

The purpose of the present invention is to provide a color image forming apparatus provided with a fixing unit that controls the dispersion of heat within the apparatus at the time of cooling the external pressure roller to the minimum level and suppresses the temperature rise of the external pressure roller so that the generation of blisters cannot be observed.

SUMMARY OF THE INVENTION

In order to solve the above problems and also achieve the purpose, one of the configurations according to the present embodiments is an image forming apparatus comprises an image bearing body, an image forming section to form a toner image on the image bearing body, a transfer section to transfer the toner image on a recording material, and a fixing apparatus having a pressure member and a heating member, which fixes the toner image on the recording material transported their between, the fixing apparatus comprises a cooling section to cool the pressure member, and a controlling section to control the cooling section according to an interval between recording materials.

DETAILED DESCRIPTION OF THE PREFERRED EMBODIMENTS

A preferred embodiment of the present invention is described below. However, the descriptions given here shall not limit the technical scope of the claims or the definitions of terms. Further, the definitive explanations in the preferred embodiment of the present invention below are only indicative of the best mode and shall not limit in any way the meanings of terms or the technical scope of the present invention.

An image forming apparatus making possible the image formation according to the present invention is described below with reference to FIG. 1.

Figure 1:
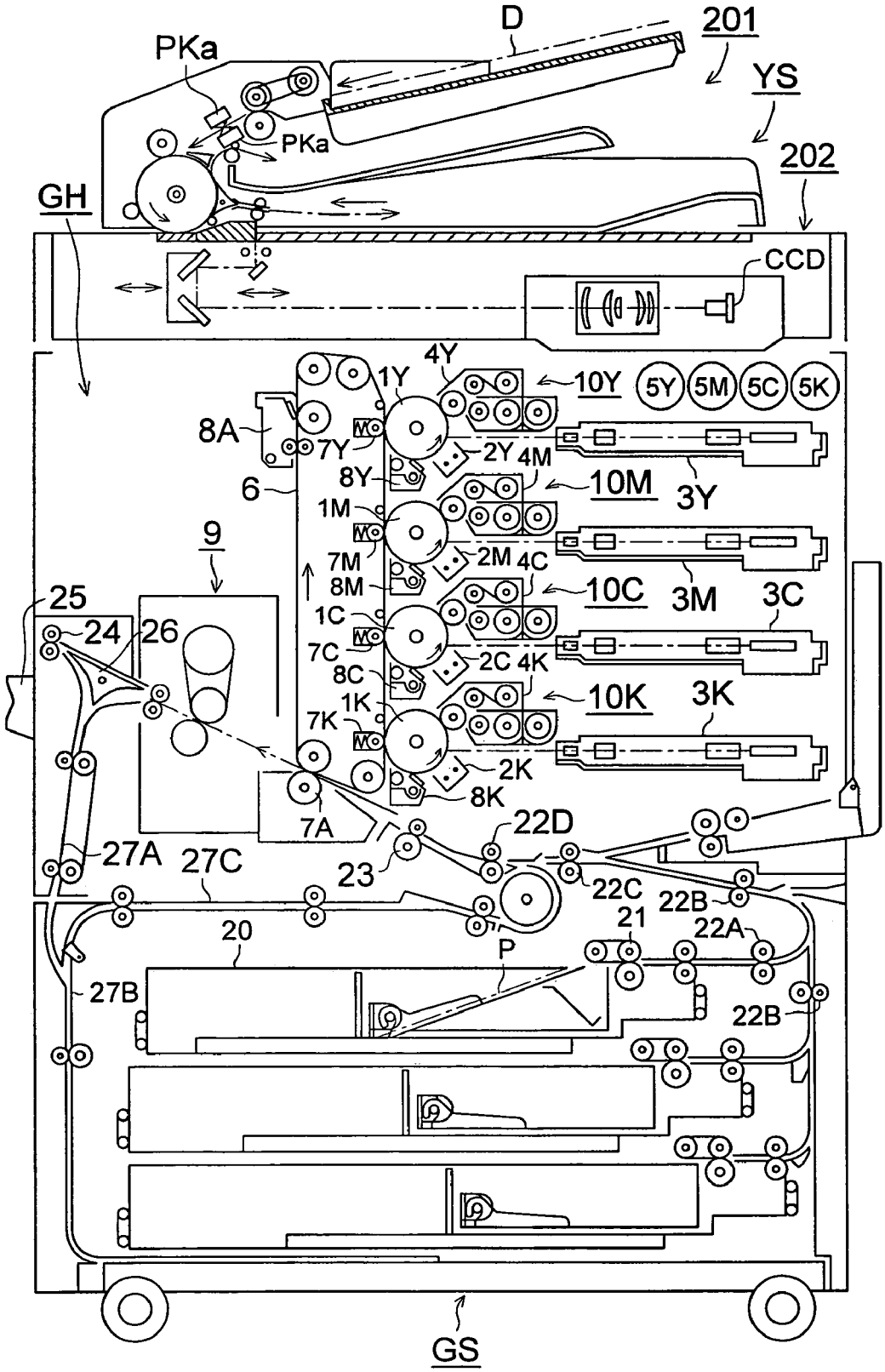
FIG. 1 is an outline cross-sectional diagram of the image forming apparatus.

In FIG. 1, the image forming apparatus GS comprises the image forming apparatus main unit GH and the image reading apparatus YS.

The image forming apparatus main unit GH is a color image processing apparatus of the tandem type and comprises plural sets of image forming sections 10Y, 10M, 10C, and 10K, a belt shaped intermediate image transfer body 6, a sheet feeding and conveying means, and a fixing unit 9 to be described later.

An image reading apparatus YS comprises an automatic document feeder apparatus 201 and a document image scanning exposure unit 203 is placed on top of the image forming apparatus main unit GH. The document D placed on top of the document table of the automatic document feeder apparatus 201 is conveyed by the document conveying means, the image on one side or both sides of the document is scanned and exposed by the optical system of the document image scanning exposure unit 202 and is read in by the line image sensor CCD. At this time, for the document D conveyed from above the document table, the judgment of glossiness of the document image, judgment of monochrome or color of the document image, and the judgment of duplex image are made by the glossiness level detection sensor PKa which is used as a glossiness level selection means.

The analog signal obtained by photoelectric conversion from the line image sensor CCD is subjected to analog signal processing, A/D conversion, shading correction, image compression, etc., in the image processing section, is stored temporarily in the memory, and then sent as signals to the image writing section (exposure means) 3Y, 3M, 3C, and 3K.

The image forming section 10Y that forms images of yellow (Y) color has a charging unit 2Y, an exposure unit 3Y, a development unit 4Y, and a cleaning unit 8Y arranged around the periphery of a photoreceptor drum 1Y which acts as the image bearing body. The image forming section 10M that forms images of magenta (M) color has a photoreceptor drum 1M which acts as the image bearing body, a charging unit 2M, an exposure unit 3M, a development unit 4M, and a cleaning unit 8M. The image forming section 10C that forms images of cyan (C) color has a photoreceptor drum 1C which acts as the image bearing body, a charging unit 2C, an exposure unit 3C, a development unit 4C, and a cleaning unit 8C. The image forming section 10K that forms images of black (K) color has a photoreceptor drum 1K which acts as the image bearing body, a charging unit 2K, an exposure unit 3K, a development unit 4K, and a cleaning unit 8K. The charging unit 2Y and the exposure unit 3Y, the charging unit 2M and the exposure unit 3M, the charging unit 2C and the exposure unit 3C, the charging unit 2K and the exposure unit 3K constitute the latent image forming means.

4Y, 4M, 4C, and 4K are developing units that store internally two-component developing agent comprise a toner and a carrier of small particle diameters of the colors yellow (Y), magenta (M), cyan (C), and black (K).

An intermediate image transfer body 6 is wound around a plurality of rollers, and is supported in a rotatable manner.

The images of each individual color formed by the image forming sections 10Y, 10M, 10C, and 10K are successively transferred onto the intermediate image transfer body 6 which rotates at a speed of 300 mm/s by the transfer section 7Y, 7M, 7C, and 7K (primary transfer), thereby forming a synthesized color image. The recording sheet P as the transfer material stored inside the sheet feeding cassette 20 is fed by the sheet feeding means 21, passes through the sheet feeding rollers 22A, 22B, 22C, and a registration roller 23, conveyed to the transfer section 7A and the color image is transferred onto the recording sheet P (secondary transfer) The recording sheet P on which the color image has been transferred is gripped in the pressing nip section N formed in the fixing unit 9 (see FIG. 2, not shown in FIG. 1), the color toner image (or the toner image) on the recording sheet P is fixed onto the recording sheet P by applying heat and pressure to it, the recording sheet is then gripped by the sheet discharge rollers 24 on the sheet discharge path side, and is then placed on the sheet discharge tray 25 outside the apparatus.

During image forming on both sides of the sheet, the recording sheet P with color image (color toner image) formed on one of its surfaces (top surface) and discharged from the fixing unit 9 is branched from the sheet discharge path by the branching means 26, which respectively constitute the sheet conveying means, passes through the recirculating sheet path 27A on the lower side, inverted in the inverting convey path 27B which is the sheet re-feeding mechanism (ADU mechanism), passes through the sheet re-feeding and conveying section 27C, and meets again at the sheet feeding roller 22D. The inversely conveyed (recirculating inverting conveyed) recording sheet P passes through the timing roller 23 conveyed again to the secondary transfer roller 7A, where a color image (color toner image) is at once transferred onto the other side (back side) of the recording sheet P. The recording sheet P with color images transferred on to it is fixed by the fixing unit 9, gripped by the sheet discharge roller 24 on the sheet discharging path side, and is then placed on the sheet discharge tray 25 outside the apparatus.

Figure 2:
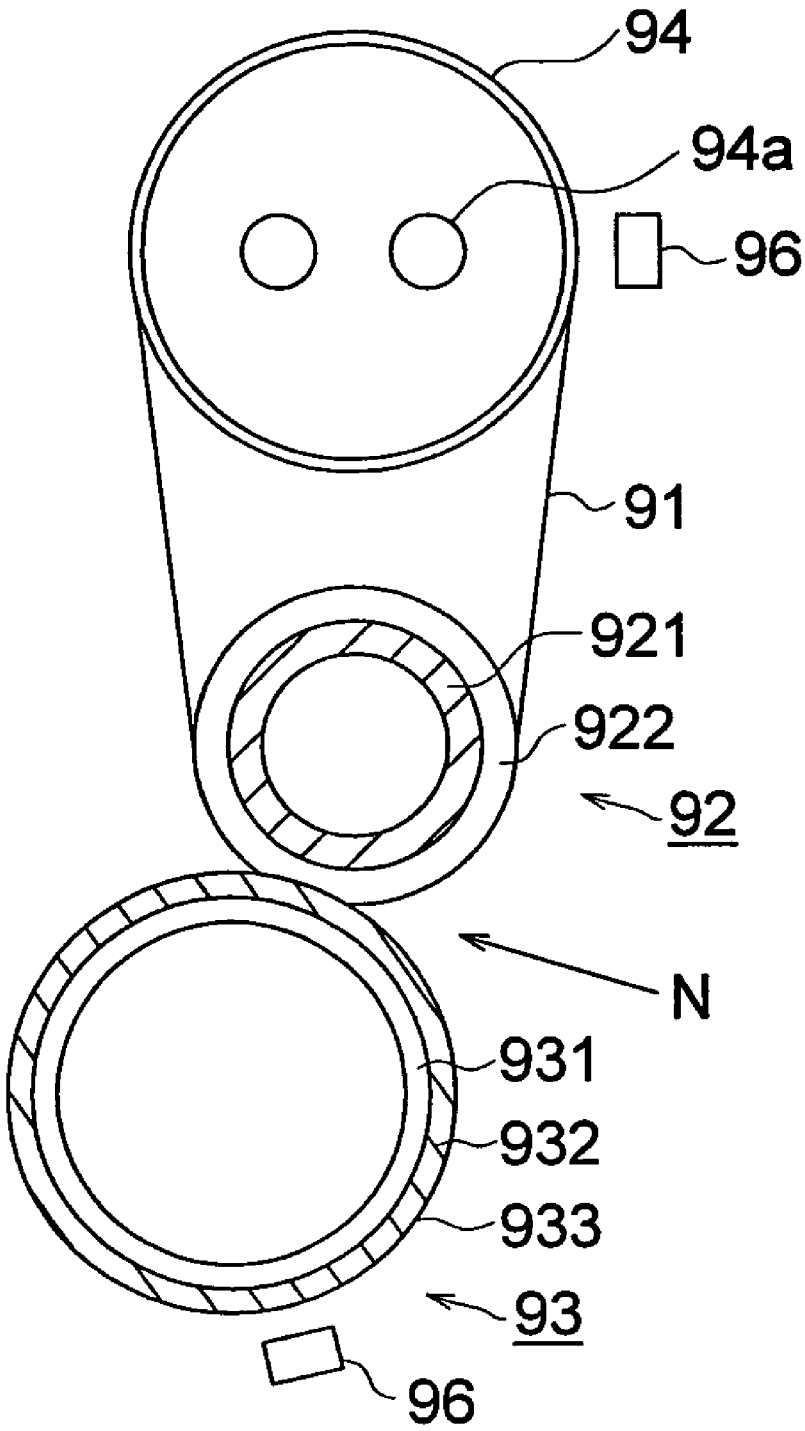
FIG. 2 is a cross-sectional diagram of the belt fixing unit.

On the other hand, after the color image is transferred onto the recording sheet P by the transfer section 7A, the residual toner on the intermediate transfer body 6 from which the recording sheet P has been separated due to difference in radius of curvature is removed by the cleaning means 8A The belt fixing unit used in the image forming apparatus according to the present invention is explained below referring to FIG. 2.

The fixing unit 9 comprises a fixing belt 91 which is a metallic base or a heat resistant plastic base and silicone rubber formed in the shape of a belt, the supporting pressure roller 92 that supports and conveys this fixing belt and carries out fixing by applying pressure and heat while gripping the transfer material and the fixing belt 91, and an external pressure roller 93 opposing this, and a supporting heating roller 94 that has inside it a heater 94*a* and that supports and conveys the fixing belt 91. In the belt fixing unit 9 of the above configuration, the pressure nip section N is formed by the supporting pressure roller 92 and the external pressure roller 93.

The supporting pressure roller 92 is a soft roller with an external diameter of 40 mm having a rotating shaft 921 made of a cylindrical metal pipe of a wall thickness of 2-5 mm or of a metal shaft, and an elastic layer 922 of 7 mm thick silicone rubber is adhered on to the rotating shaft 921 on the outer periphery.

The external pressure roller 93 is a soft roller with an external diameter of 50 mm having a hollow rotating shaft 931 with an internal diameter of 38 mm and made of a cylindrical aluminum pipe of a wall thickness of 3 mm, an elastic layer 932 of 2 mm thick silicone rubber is adhered on the outer periphery of the rotating shaft 931, and the outside of which is provided a PFA (Perfluoroalkoxyethylene) tube 933 as the separating layer.

Since a softer material has been used for the elastic layer 922 of the supporting pressure roller 92 compared to the elastic layer 932 of the external pressure roller 93 and also since the elastic layer is thick, in the pressing nip section N the supporting pressure roller 92 gets deformed mainly thereby maintaining the pressure contact state. In the preferred embodiment, a 14 mm nip section is being formed by applying a weight of 900 N. In addition, during the warming up period when pre-heating is carried out, the external pressure roller 93 is in contact with the supporting pressure roller 92 via the fixing belt 91 with a pressing force of 350 N. Further, the external pressure roller 93 maintains the pressing state during continuous printing, and moves to the separated state once the printing operation is completed.

Figure 3:
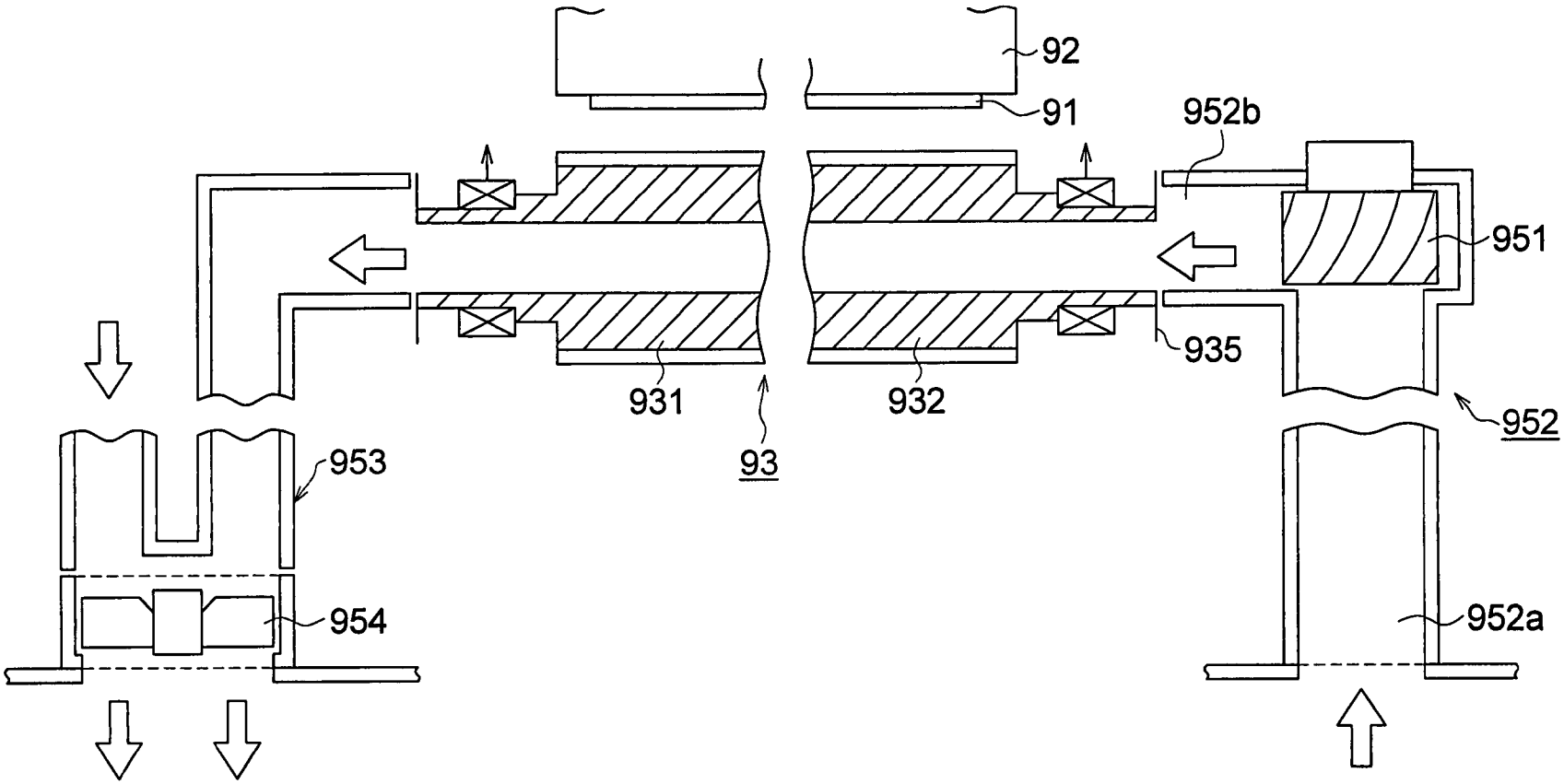
FIG. 3 is a cross-sectional diagram showing the air flow path.

In the present preferred embodiment, air flow due to an ON/OFF controlled fan motor 951 is passed inside the external pressure roller 93 via a duct 952. FIG. 3 is a cross-sectional diagram showing the air flow path.

Due to the drive of the fan motor 951, the air outside the apparatus is sucked from the air suction inlet 952*a* which is one end of the duct 952 and is exhausted from the air exhaust outlet 952*b*. Since the external pressure roller 93 moves in contrast with the duct 952 which is in a fixed position, there is a air flow preventing member 935 at the end of the external pressure roller 93 opposite the air exhaust outlet 952*b*, all the air exhausted from the air exhaust outlet 952*b* passes through the hollow external pressure roller 93 thereby cooling it, and in the present preferred embodiment, the drive rotation of the fan motor 951 is switched between the two air speed levels of 12 m/s and 6 m/s of the air flowing inside the external pressure roller 93. The warm air coming out of the external pressure roller 93 passes through the duct 953 for air exhaust, and is discharged to outside the apparatus along with other exhaust air by the axial flow fan 954. Further, since the air flow path is narrow for the air flow with the fan motor 951, a sirocco fan, which has a high static pressure and is suitable for applications with large pressure losses, is used desirably, however, it is not necessary to limit to such a fan.

The fixing belt 91 trained about the supporting pressure roller 92 is an 80 mm diameter endless belt having a 70 μm thick polyimide base on the outside of which is provided a 200 μm silicone rubber layer and a 30 μm PTFE coating layer. The fixing belt 91 is heated by thermal conduction transmitted via the heating roller from the heater 94*a* built inside the supporting heating roller 94 around which the belt is passed.

The supporting heating roller 94 is a 50 mm external diameter roller which is an aluminum core metal of wall thickness 2 mm on the outer periphery of which is provided a fluorocarbon resin layer, and slide guards are provided at the two ends of the roller thereby restricting the position of the fixing belt 91 so that it does not slide in the axial direction.

Figure 4:
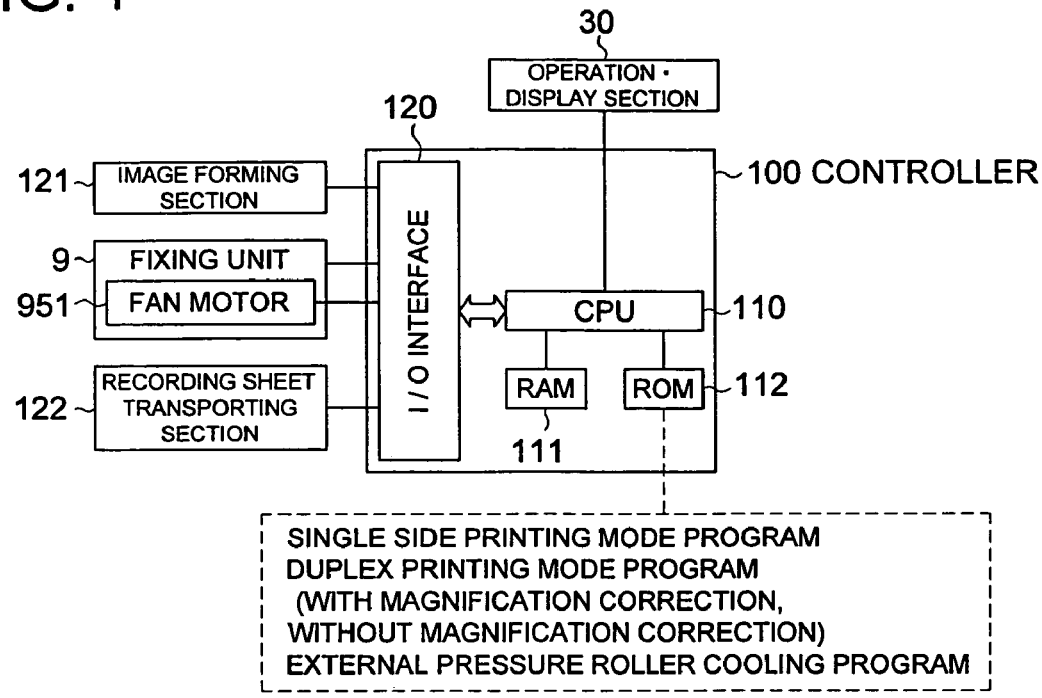
FIG. 4 is an outline block diagram of the electrical control system.

FIG. 4 shows an outline block diagram of the electrical control system. In this FIG. 110 is a CPU that carries out computer control processing to which are connected a RAM 111 and a ROM 112. The ROM 112 stores basic data for computation, the simplex image forming mode program, the duplex image forming mode program, the external pressure roller cooling program of the present invention, etc, and the CPU 110 is connected to external devices via the interface 120.

The image forming section 121 such as the charging unit 2, the exposure unit 3, the developing unit 4, etc., the fixing unit 9, the recording sheet transporting section 122 that carries out feeding, conveying, inverted conveying, sheet discharge, etc., of the recording sheet are connected to the interface 120.

Further, in the image forming apparatus shown in FIG. 1, an operation/display section 30 has been provided which has the START button for instructing the starting of the print operations, the size selection button for selecting the size of the recording sheets used, the ten-keys for specifying the number of recording sheets to be printed, the image density selection buttons for selecting the image density, and also the singe side image or duplex image printing, and also the magnification correction and no magnification correction selection buttons during duplex image printing.

When the user selects the simplex image printing and then pushes ON the START button in the operation/display section 30, the CPU 110 calls the simplex image forming mode program from the ROM 112, and carries out control of image forming according to the called program. In other words, the CPU 110 controls the recording sheet transporting section 122 so that it issues the recording sheet P from the corresponding sheet feeding cassette 20, controls the image forming section 121 so that it transfers the toner image formed on the intermediate image transfer body 6 on to the recording sheet P, and carries out control so that the toner image is fixed by passing the recording sheet P carrying a toner image on one of its sides through the fixing unit 9, and then the recording sheet P is discharged to outside the apparatus by passing through the sheet discharge path.

Further, when the user selects the duplex image printing and then pushes ON the START button in the operation/display section 30, the CPU 110 calls the duplex image forming mode program from the ROM 112, and carries out control of image forming according to the called program. In other words, the CPU 110 controls the recording sheet transporting section 122 so that it issues the recording sheet P from the corresponding sheet feeding cassette 20, controls the image forming section 121 so that it transfers the toner image formed on the intermediate image transfer body 6 on to one surface (the top surface) of the recording sheet P, and carries out control so that the toner image is fixed by passing the recording sheet P carrying a toner image on one of its sides (the top surface) through the fixing unit 9, then conveys the recording sheet via the inverting conveying path again to the transfer section 7A, controls the image forming section 121 so that it transfers the toner image formed on the intermediate image transfer body 6 on to the other surface (the back side) of the recording sheet P, and carries out control so that the toner image is fixed by passing the recording sheet P having a toner image transferred on to it through the fixing unit 9, and then the recording sheet P having images on both sides is discharged to outside the apparatus by passing through the sheet discharge path.

In the present preferred embodiment, it is possible to select in the duplex image forming mode program any one of the two modes with magnification correction or without magnification correction in top and backside images.

When high image quality is required, the mode with magnification correction is provided in order to prevent a difference being present in the image magnification ratios of the top and back sides because the recording sheet shrinks due to fixing during duplex image formation, and when the magnification correction mode has been selected, changes are made in the magnification ratios of unfixed images during image formation on the top and back sides. Since the polygon rotational speed is changed while changing the magnification ratio, in order to acquire time for changing the rotational speed, the control is carried out so that the output is made at every three sheets while skipping the image formation and fixing of one sheet in the mode with magnification correction as compared to carrying out top and back side fixing for every four sheets normally in the present preferred embodiment.

On the other hand, if high speed printing operations are required during duplex image formation, the mode without magnification correction is selected, and control is carried out so that top and back side fixing is carried out at every four sheets.

In the present invention, in parallel with the simplex image formation or duplex image formation mode program, the external pressure roller cooling program stored in the ROM 112 is called, and the CPU 110 carries out control of the cooling operations of the external pressure roller 93 by driving the fan motor 951 based on the information input from the operation/display section 30.

In the preferred embodiment described next, the external pressure roller cooling program is a program that controls the operation of the fan motor 951, which is a cooling means, based on the sheet interval ratio at the time of image formation.

When the temperature of the external pressure roller is predicted to rise up to the temperature at which blisters occur at the sheet interval ratio and number of sheets to be printed specified in the image output signal from the operation/display section 30, the air flow due to the fan motor 951 is started before the temperature of the external pressure roller rises up to the temperature at which blisters occur. The rise in the temperature of the external pressure roller is determined by the basis weight of the sheet and the sheet interval ratio, and should be determined by experiment for each fixing system.

Figure 5:
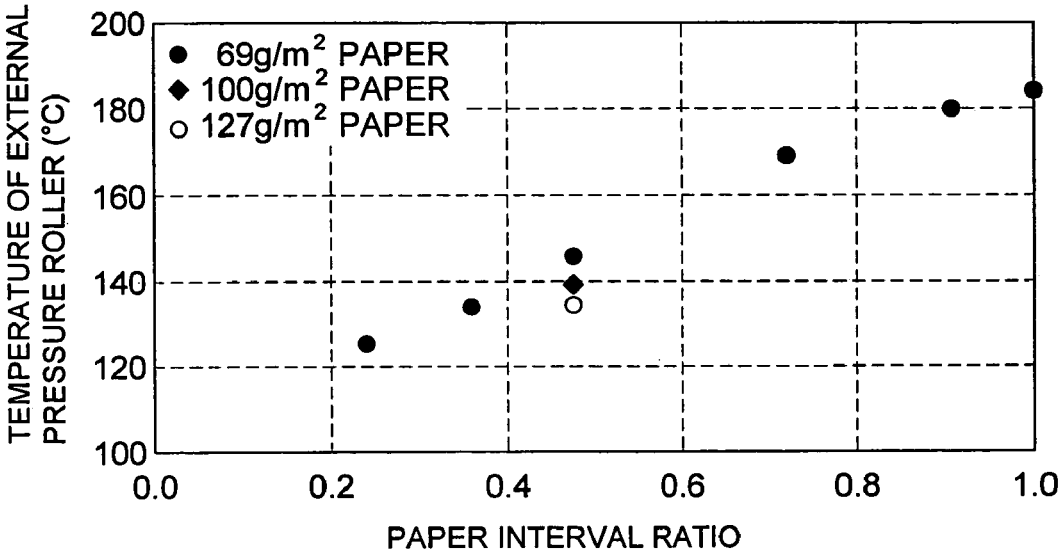
FIG. 5 is a graph showing the relationship between the paper interval ratio and the external pressure roller temperature.

The sheet interval ratio is defined as the ratio of the sheet interval (the space between one print sheet and the next print sheet) to the distance traveled by the fixing member (in this case, the fixing belt 91). When A4 sized (210 mm) sheets are fixed at 90 mm sheet interval, that is, when fixed at 60 ppm (prints per minutes) at a speed of 300 mm/s, the sheet interval ratio is 90/(210+90)=0.3. And, if the productivity is made 3/4 in order to match the top and back sides (magnification ratio correction) during duplex image formation as in the manner described above, the sheet interval ratio becomes (90×4+210)/{(210+90)×4}=0.48. FIG. 5 is a graph showing an example of the relationship between the paper interval ratio and the saturation external pressure roller temperature.

From the above figure, it can be seen that there is a trend for the external pressure roller saturation temperature to rise as the sheet interval ratio becomes larger. Further, it indicates that there is a trend of the external pressure roller saturation temperature to decrease as the basis weight increases in the coated sheet.

Figure 6:
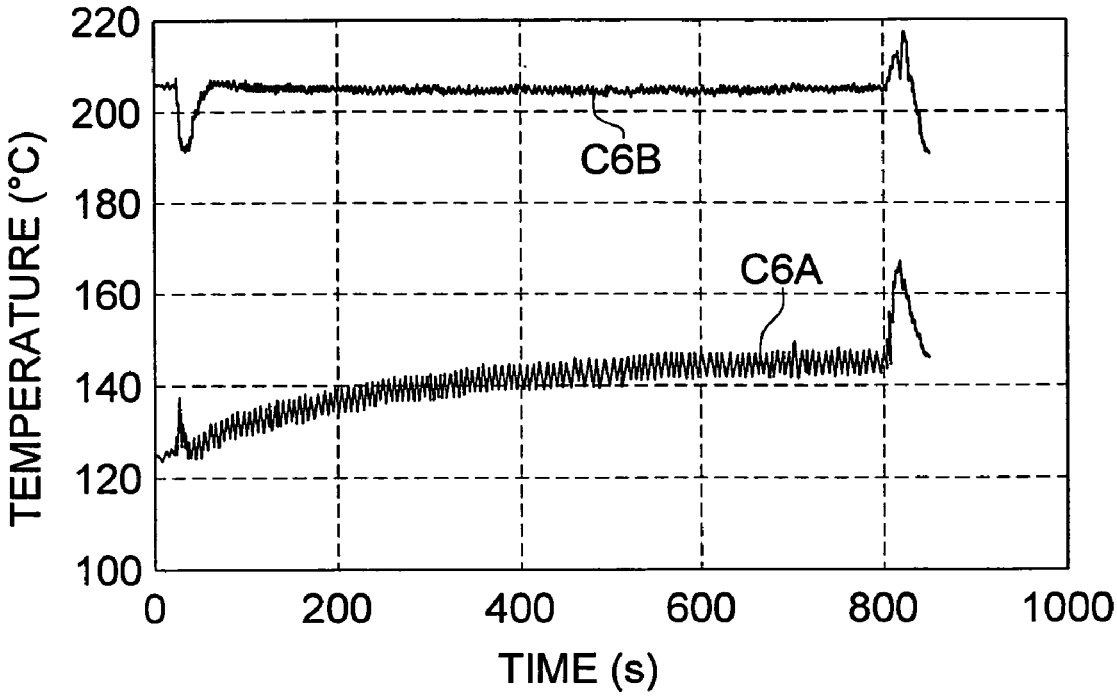
FIG. 6 is a graph showing the trend of the temperature of the fixing belt and the external pressure roller.

The graph shown in FIG. 6 gives the temperature trend C6B of the fixing belt 91 and the temperature trend C6A of the external pressure roller 93 when 69 g/m$^2$ sheets are fixed at a rate of 45 ppm. The temperature of the external pressure roller 93 slowly increases by receiving heat from the belt between sheets due to pressure contact with the high temperature fixing belt 91. After 250 s from the start of sheet feeding, that is, after about 200 sheets are printed, the temperature of the external pressure roller 93 reaches 140° C., which is a level at which blisters appear significantly with intolerable level.

At sheet interval ratios and sheet basis weights at which the temperature of the external pressure roller 93 exceeds the permissible temperature in this manner, the fan motor 951 for cooling is driven, thereby suppressing the temperature rise of the external pressure roller 93. When air at room temperature is passed at an air flow speed of 12 m/s by the fan motor 951 inside the rotating shaft 922 which is the metal core, the saturation external pressure roller temperature under the same conditions was 115° C., and hence it was possible to suppress the temperature to a level at which the blistering was permissible. Of course, when wanting to suppress blistering more completely, it is also possible to operate at a still lower estimated temperature rise.

In actual control, even without calculating the sheet interval ratio, it is possible to determine the operation of the fan motor 951 based on a table of sheet size and productivity etc. An operation table of sheet size versus cooling fan operation is shown below as an example.

TABLE 1

| Sheet size | Simplex print | Duplex print (without magnification ratio correction) | Duplex print (with magnification ratio correction) |
|---|---|---|---|
| B6 | L | H | H |
| B5 | L | H | H |
| B4 | L | L | H |
| A6 | L | L | H |
| A5 | OFF | L | H |
| A4 | OFF | OFF | L |
| A3 | OFF | OFF | OFF |

The CPU 110 drives the fan motor 951 in any one of the states of H (motor drive to get an air flow speed of 12 m/s), L (motor drive to get an air flow speed of 6 m/s), and OFF according to the sheet size at which the printing is to be made input from the operation/display section 30 and depending on which print mode is being used among simplex, duplex (without magnification ratio correction), duplex (with magnification ratio correction).

Further, it is desirable to add also in this table the information from the temperature sensor or the humidity sensor installed in the image forming apparatus, and to carry out control so that the external pressure roller temperature is still lower under conditions in which blisters are likely to be generated.

In the present preferred embodiment, in order to suppress to a minimum the discharge of warm air to outside the apparatus, the fan is not driven if the temperature rise of the external pressure roller is estimated to be at a level at which blistering is not noticeable. Since, by not driving the fan it is possible to reduce the heater power and the fan power consumptions, it is desirable not to drive the fan when not necessary from the point of view of energy saving. It is also possible to drive the fan at all times when image quality is given priority and when using sheets with the basis weight being such that blisters are easily generated (for example, sheets of 100 g/m$^2$ or less).

The fan is stopped when sheet conveying is finished. Since the temperature inside the external pressure roller is lower, even if the fan is stopped immediately after the sheet conveying is finished, there is no possibility of the sudden temperature rise as in the case of the fixing roller which has a built-in heater.

The cooling air is injected from the opening section at the ends of the external pressure roller rotating shaft 931 and is exhausted from the outlet section on the other side. Compared to the case of cooling the roller from the outside, forming the air guidance path is easier and it is possible to suppress dispersion of heat to the interior of the apparatus.

Further, by maintaining the external pressure roller temperature low, the temperature difference occurring at the boundary between the area of contact of the belt with the external pressure roller and the area of contact with the sheet remains up to one revolution of the belt, and have the effect of reducing the defects of creating steps in the glossiness.

By having this type of configuration and control, it is possible to provide an image forming apparatus that can carry out high quality image formation with suppressed generation Of blisters and without defects caused by the temperature rise inside the apparatus. Further the fixing unit may be provided with temperature detector 96 to detect the temperature of the external pressure roller, and the cooling means may be configured to be controlled based on the temperature of the external pressure roller.

In the preferred embodiment described next, the external pressure roller cooling program is one that carries out control of the operation of the fan motor 951, which is the cooling means, based on the basis weight of the recording sheet during image formation.

The generation of blisters is decided by the basis weight of the recording sheet and the temperature of the external pressure roller. The status of generation of blisters in the present preferred embodiment is shown in the table below.

TABLE 2

| | External pressure roller temperature (° C.) | | | | |
|---|---|---|---|---|---|
| | 100 | 120 | 140 | 160 | 180 |
| 80 g/m$^2$ sheet | A | B | C | C | C |
| 100 g/m$^2$ sheet | A | A | B | C | C |

TABLE 2-continued

| | External pressure roller temperature (° C.) | | | | |
|---|---|---|---|---|---|
| | 100 | 120 | 140 | 160 | 180 |
| 128 g/m$^2$ sheet | A | A | A | B | C |
| 158 g/m$^2$ sheet | A | A | A | A | A |

In the above table, C indicates that the rate of generation of blisters is high, B indicates that blisters are generated occasionally during image formation, and A indicates that good fixed images can be obtained without the generation of blisters.

The sheets are in contact with the external pressure roller 93 during sheet conveying, if the amount of heat supplied from the belt through the contact between the fixing belt 91 and the external pressure roller 93 during the intervals of sheets is more than the amount of heat taken away from the external pressure roller 93, the temperature of the external pressure roller increases gradually. When a thin coated sheet of 80 g/m$^2$ is used with a speed of 300 mm/s at a productivity rate of 65 ppm, the temperature of the external pressure roller stays at around 120-130° C. During the operation of carrying out magnification ratio correction in the duplex image forming mode, the productivity becomes 48 ppm and the sheet interval becomes double, the external pressure roller temperature becomes 150° C. when using 80 g/m$^2$ sheets, and increases up to 140° C. even with 100 g/m$^2$ sheets.

Further, although the above table is for an ambient temperature of 25° C. and an ambient humidity of 40% RH, at still higher temperatures and humidity, if the moisture content of the sheet becomes higher, the temperature of generation of blisters becomes lower.

Also in the present preferred embodiment, the control operation of the fan motor 951 can be determined based on the table of the basis weight of the sheets and the productivity, etc. The following is an example showing a table of basis weight of sheets and cooling fan operation.

TABLE 3

| Basis weight (g/m$^2$) | Simplex print | Duplex print (magnification correction not present) | Duplex print (magnification correction present) |
|---|---|---|---|
| 80 | L | H | H |
| 100 | OFF | L | H |
| 128 | OFF | OFF | L |
| 158 | OFF | OFF | OFF |

The CPU 110 drives the fan motor 951 in any one of the states of H, L, and OFF from the above table according to the basis weight of sheets with which the printing is to be made input from the operation/display section 30 and depending on which print mode is being used among simplex, duplex (without magnification ratio correction), duplex (with magnification ratio correction).

By having this type of configuration and control, it is possible to provide an image forming apparatus that can carry out high quality image formation with suppressed generation of blisters and without defects caused due to temperature rise inside the apparatus.

In the above explanations, cooling the external pressure roller 93 as necessary was described as a means for preventing blisters. However, it is not desirable to cool the external pressure roller 93 unconditionally.

Since the problem of increased curling of sheets occurs if the temperature of the external pressure roller becomes too low, the heating is maintained up to a temperature of about 100° C. Since the cooling performance is lost if a heater is placed inside the external pressure roller 93, a heater was not provided in the present preferred embodiment. Instead, the fixing belt 91 and the external pressure roller 93 are rotated while pressing against each other, and the external pressure roller 93 is heated through the belt. When raising the temperature of the external pressure roller immediately after switching ON the power supply or after a waiting period, the fan motor 951 is kept stopped, current is supplied through the heater of the heating roller, and the external pressure roller 93 is rotated in pressure contact with the belt.

If there is any margin in the cooling air flow path or in the capacity of the air blowing means, it is also possible to incorporate a heater inside the external pressure roller 93 for heating it quickly and without placing a load on the belt.

According to the above embodiment, by carrying out the control of cooling the external pressure member which is the pressing member so as to carry out cooling operation based on the sheet interval ratio at the time of image formation, the cooling means is controlled to be operated in an positive manner under conditions in which temperature rise of the external pressure member is likely to occur, thereby preventing effectively the rise of the external pressure roller temperature up to the temperature at which blisters can be generated easily, and hence it is possible to obtain satisfactorily fixed images without the generation of blisters.

According to the above embodiment, by carrying out control of the cooling means that carries out cooling of the external pressure member so as to carry out cooling operation based on the basis weight of recording sheets at the time of image formation, the cooling means is controlled to be operated in an positive manner to the recording sheets, the basis weight of which can generate blisters easily, thereby preventing effectively the rise of the external pressure roller temperature up to the temperature at which blisters can be generated easily in each recording sheet, and hence it is possible to obtain satisfactorily fixed images without the generation of blisters.

According to the above embodiment, cool air from outside the apparatus is supplied with an ensured air flow rate into the metal core of the hollow external pressure roller which is linked to a fan via a duct, it is possible to obtain satisfactorily fixed images without the generation of blisters, because the cooling operation is carried out satisfactorily without the warm air after cooling getting dispersed inside the apparatus and causing thermal contamination.

What is claimed is:

1. An image forming apparatus comprising:

an image bearing body;

an image forming section to form a toner image on the image bearing body;

a transfer section to transfer the toner image on a recording material; and a fixing apparatus having a pressure member and a heating member, the fixing apparatus fixing the toner image on the recording material transported through the fixing apparatus, the fixing apparatus comprising:

a cooling section to cool the pressure member; and a controlling section to control the cooling section according to a ratio of a distance of an interval between recording materials to a traveling distance of a fixing member.

2. The image forming apparatus of claim 1, wherein the interval between recording materials is varied according to print modes, wherein the print modes have at least a simplex printing mode and a duplex printing mode.

3. The image forming apparatus of claim 2, wherein the interval between recording materials is varied according to duplex printing modes, wherein the duplex printing modes have at least a mode with magnification correction and a mode without magnification correction.

4. The image forming apparatus of claim 1, wherein the interval between recording materials is varied according to a productivity of image formed sheets.

5. The image forming apparatus of claim 1, wherein the interval between recording materials is varied according to a size of the recording material.

6. The image forming apparatus of claim 1, wherein the controlling section controls an actuation of the cooling section according to the interval between recording materials.

7. The image forming apparatus of claim 1, wherein the pressure member is made as a hollow pipe and the cooling section passes air to the hollow pipe so as to cool the pressure member.

8. The image forming apparatus of claim 1, wherein the controlling section additionally controls the cooling section according to a basic weight of the recording material.

9. An image forming apparatus comprising:

an image bearing body;

an image forming section to form a toner image on the image bearing body;

a transfer section to transfer the toner image on a recording material; and a fixing apparatus having a pressure member and a heating member, the fixing apparatus fixing the toner image on the recording material transported through the fixing apparatus, the fixing apparatus comprising:

a cooling section to cool the pressure member, the pressure member including a hollow pipe, the cooling section passing air to the hollow pipe so as to cool the pressure member; and a controlling section to control the cooling section according to an interval between recording materials.

* * * * *